United States Patent [19]

Thoma et al.

[11] Patent Number: 4,479,855

[45] Date of Patent: Oct. 30, 1984

[54] GALVANIC DISPERSION DEPOSITION BATH

[75] Inventors: Martin Thoma; Paul Buenger, both of Munich, Fed. Rep. of Germany

[73] Assignee: MTU Motoren-und Turbinen-Union Muenchen GmbH, Munich, Fed. Rep. of Germany

[21] Appl. No.: 592,852

[22] Filed: Mar. 23, 1984

[30] Foreign Application Priority Data

Apr. 16, 1983 [DE] Fed. Rep. of Germany ..... 3313871

[51] Int. Cl.[3] ..... C25D 15/00

[52] U.S. Cl. ..... 204/16; 204/DIG. 2

[58] Field of Search ..... 204/16, DIG. 2

[56] References Cited

U.S. PATENT DOCUMENTS

| | | | |
|---|---|---|---|
| 3,844,910 | 10/1974 | Lipp | 204/16 |
| 3,891,542 | 6/1975 | Cordone | 204/16 |
| 4,098,654 | 7/1978 | Helle | 204/16 |
| 4,222,828 | 9/1980 | Zuurdeeg | 204/16 |

FOREIGN PATENT DOCUMENTS

| | | | |
|---|---|---|---|
| 2644035 | 11/1979 | Fed. Rep. of Germany | 204/16 |

*Primary Examiner*—Thomas Tufariello

*Attorney, Agent, or Firm*—W. G. Fasse; D. H. Kane, Jr.

[57] ABSTRACT

A bath or electrolyte for the galvanic deposition of a metal matrix layer having embedded therein particles of a non-metallic substance, comprises a stabilizer for keeping such non-metallic substances uniformly suspended in the bath for the duration of the electrolysis. The suspension stabilizer is a cation active imidazole derivative satisfying the general formula

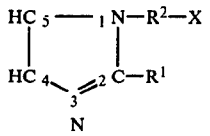

wherein $R^1$ is preferably a monovalent, saturated or unsaturated hydrocarbon radical having at least four aliphatically bound C-atoms, $R^2$ is a methylene (carbene), or ethylene, or propylene or isopropylene group, and wherein X is selected from $—NH_2$, $—NHR^3$, $—NR^3R^4$, —OH, or $OR^5$, whereby $R^3$, $R^4$ and $R^5$ are methyl, ethyl, or propyl or polyglycolether radicals having up to five $—O—CH_2—CH_2$ groups.

19 Claims, No Drawings

GALVANIC DISPERSION DEPOSITION BATH

FIELD OF THE INVENTION

The invention relates to a bath for a galvanic dispersion deposition. More specifically, the invention relates to an electrolyte for the galvanic deposition of metal layers having non-metallic particles embedded in the metal layers. Such bath or electrolyte comprises a suspension stabilizer for the non-metallic particles suspended in the bath or electrolyte prior to the deposition of the metal layers with the non-metallic particles embedded in such layers.

DESCRIPTION OF THE PRIOR ART

The galvanic deposition of metal layers or coatings having other substances, especially, non-metallic particles embedded in such layers or coatings is known in the art as an easy way of producing dispersion materials. In the following text such galvanic depositions will be referred to as galvanic dispersion deposition or simply as depositions. The other substances, such as non-metallic particles, are suspended in the electrolytic, galvanic bath and are deposited on the cathode during the electrolysis together with the matrix metal, whereby the matrix metal grows around the particles of the other substance and which are thus embedded in the matrix metal.

The quality of a galvanic dispersion deposition depends to a large extent on the type and characteristics of the suspension stabilizer present in the galvanic bath. The stabilizer functions as a surfactant more specifically as a wetting agent that must make sure that the particles suspended in the electrolyte are properly wetted. If this requirement is not or only incompletely satisfied, the particles in the electrolytic bath settle too rapidly even if one keeps stiring the bath or even if the bath is kept in motion otherwise. As a result, the concentration of particles in the bath changes during the electrolysis and the particle distribution in the deposited metal matrix becomes non-uniform.

German Patent (DE-PS) No. 2,644,035 discloses ways for successfully performing a dispersion deposition if imidazole derivatives are specially added to the electrolyte as a suspension stabilizer. These special imidazole derivatives must have an amphoteric character as a result of linking carboxyl radicals and/or sulfuric acid groups or radicals with the imidazole derivatives.

German Patent No. 2,644,035 does not disclose any suspension stabilizers having cation active characteristics.

U.S. Pat. No. 4,222,828 discloses cation active substances suitable as suspension stabilizers useful for the stabilizing purpose provided they have long chain fluorocarbon radicals. U.S. Pat. No. 4,222,828 does not disclose anything with regard to the suitability of cation active materials as suspension stabilizers if these materials do not have such long chain fluorocarbon radicals.

OBJECTS OF THE INVENTION

In view of the above it is the aim of the invention to achieve the following objects singly or in combination:

to provide suspension stabilizers for an electrolytic bath which will assure the proper wetting of non-metallic particles suspended in the bath to prevent the premature settling of the non-metallic particles;

to assure a uniform concentration or distribution of non-metallic particles in an electrolytic bath throughout the bath volume and throughout the duration of an electrolytic dispersion deposition; and to provide an efficient dispersion depositon method for producing a material having non-metallic particles uniformly embedded in a metal matrix.

SUMMARY OF THE INVENTION

The invention provides an electrolytic bath for a galvanic dispersion deposition, comprising a suspension stabilizer in the form of a cation active imidazole derivative satisfying the general formula

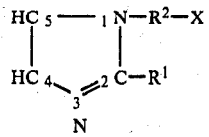

wherein $R^1$ is a monovalent hydrocarbon radical having at least four aliphatically bound C-atoms, wherein $R^2$ is selected from the group consisting of methylene (carbene) ethylene, propylene, and isopropylene; wherein X is selected from the group consisting of $—NH_2$, $—NHR^3$, $—NR^3R^4$, and $—OR^5$; and wherein $R^3$, $R^4$ and $R^5$ are selected from the group consisting of methyl radicals, ethyl radicals, propyl radicals, and polyglycolether radicals having up to five $—O—CH_2—CH_2$ units.

The hydrocarbon radicals $R^1$ are either saturated or unsaturated and they may comprise mixtures of several such saturated and/or unsaturated hydrocarbon radicals $R^1$ having at least four aliphatically bound C-atoms.

A preferred suspension stabilizer is provided if $R^1$ in the above formula is a mixture of aliphatic saturated and unsaturated hydrocarbon radicals having eight to eighteen C-atoms, preferably sixteen to eighteen C-atoms for example tallow radicals, especially a heptadecenyl radical, if $R^2$ is an ethylene group, and if X is a primary amino group or a hydroxyl group.

It is surprising that contrary to the teaching of the above mentioned U.S. Pat. No. 4,222,828, certain cation active materials not having any fluorine can be very effective suspension stabilizers in a galvanic dispersion deposition bath. This finding of the invention is the more surprising since with regard to imidazole derivatives, as used according to the invention, it would have been expected that these imidazole derivatives would have to have an amphoteric character in view of the disclosure of the above mentioned German Patent No. 2,644,035. Surprisingly, the stabilizers according to the invention do not require an amphoteric character.

DETAILED DESCRIPTION OF PREFERRED EXAMPLE EMBODIMENTS AND OF THE BEST MODE OF THE INVENTION

Experiment No. 1

The following solution is prepared thereby using deionized water:

630 ml/liter of an aqueous nickel sulphamate solution having a concentration of 600 to 680 grams of solid sulphamate per liter;

5 grams/liter of nickel chloride ($NiCl_2 \cdot 6H_2O$); and 40 grams/liter of boric acid ($H_3BO_3$).

2.5 liters of the above solution are used as the main or basic electrolyte which is kept in motion during the experiment by a mechanical stirrer. The anode used in the experiment was a plate of carbonized nickel in accordance with German Industrial (DIN) Standards Sheet No. 1702. The cathode used in the experiment was a plate of a nickel alloy known as X10 CrNiTi 189* and having the dimensions 50 mm by 100 mm. The cathode plate was 1 mm thick. The anode had the dimensions 150 mm by 50 mm by 50 mm Prior to starting the experiment, the cathode was electrolytically degreased and subjected to an anodic etching and to a preliminary nickel plating as is known in the art.

composition disclosed in "Werkstoff-Leistungsblatt" MTN 12175 as attached.

Non-metallic particles in the form of silicon carbide SiC and a suspension stabilizer are then mixed into the above main or basic electrolyte. The SiC particles have a particle size of 2 μm and are used to the extent of 150 grams per liter of electrolyte. The suspension stabilizer is used to the extent of 0.8 grams per liter of electrolyte. In this first experiment the suspension stabilizer is a 1-aminoethyl-2-alkyl-alkenyl-imidazole, whereby in this context the "alkyl-alkenyl" components are a mixture of alkyl radicals and alkenyl radicals having 16 to 18 C-atoms, as they occur particularly in animal tallow.

The galvanic deposition of the SiC is now performed at a bath temperature of 50±1° C. and at a pH value within the range of about 3.8 to 4.0. Several individual experiments have been made at different cathodic current densities, and at an electrolysis duration resulting in a cathodic deposition layer thickness of about 20 μm. It may be taken as a guideline that such a layer thickness of 20 μm is deposited in about one hour if the cathodic current density is 2 ampheres per $dm^2$. The same layer thickness may be deposited in about ten minutes if the cathodic current density is 10 amps/$dm^2$.

The following Table I shows the embedding rate of SiC, in percent by weight, in the deposited nickle matrix as a function of or at different cathodic current densities.

TABLE I

| Suspension Stabilizer: 1-aminoethyl-2-alkyl-alkenyl-imidazole | |
|---|---|
| cathodic current density (amp/$dm^2$) | SiC - embedding rate (% by weight) |
| 1 | 6.8 |
| 5 | 7.3 |
| 10 | 6.6 |
| 15 | 6.3 |
| 20 | 6.1 |
| Suspension Stabilizer Concentration | 0.8 g/l |
| SiC-Concentration | 150 g/l |

Table I shows that very good embedding rates are achieved throughout the range of current densities from 1 amp/$dm^2$ to 20 amp/$dm^2$. The best embedding rate or results of 7.3% by weight are obtained at a current density of 5 amp/$dm^2$.

The dispersion depositions have been tested by bending the cathode sheet metal members through an angle of 90° to ascertain the adhesive strength or bonding strength which holds the deposits on the cathodic substrate. Such strength was found to be excellent since no separation occurred even at a 90° bend. Further, embrittlements have not been noticed in any of the test samples prepared at the current densities set forth in Table I.

Experiment No. 2

Experiment No. 1 is repeated, however, with the suspension stabilizer now being 1-hydroxylethyl-2-heptadecenyl-imidazole, rather than 1-aminoethyl-2-alkyl-alkenyl-imidazole. Here again an optimal particle embedding rate of 7.3% by weight is achieved with a good bonding strength without any embrittlement of dispersion deposits.

Experiment No. 3

Experiment No. 1 is repeated except that now titanium carbide (TiC) particles are suspended in the electrolyte instead of the SiC particles. The TiC particles have a particle size of about 0.4 μm and their concentration is 100 grams per liter. The optimal embedding rate in this experiment was 5% by weight in the deposited Ni-matrix.

Experiment No. 4

Experiment No. 1 is repeated except that now 100 grams/liter of aluminum oxide particles ($Al_2O_3$) are suspended in the electrolyte instead of the SiC particles. These $Al_2O_3$ particles have a particle size of about 0.6 μm. The optimal embedding rate was 6% by weight in the deposited Ni-matrix.

Experiment No. 5

Experiment No. 1 is repeated except that now 100 grams/liter of titanium dioxide particles are suspended in the electrolyte instead of the SiC particles. The titanium dioxide ($TiO_2$) particles have a particle size of about 3 to 5 μm. The optimal embedding rate was 8% by weight in the deposited Ni-matrix.

Experiment No. 6

The basic or main electrolyte of Experiment No. 1 is replaced by the following electrolyte:

430 to 470 grams/liter of cobalt sulfate ($CoSO_4 \cdot 7H_2O$), 15 to 20 grams/liter of Sodium Chloride (NaCl), and 25 to 35 grams/liter of boric acid ($H_3BO_3$).

The non-metallic particles in the form of aluminum oxide ($Al_2O_3$) having a particle size of about 0.6 μm were suspended in the electrolyte to the extent of 100 gram/liter. The suspension stabilizer was 0.8 grams/liter of 1-aminoethyl-2-alkyl-alkenyl-imidazole. The pH value was within the range of 4.3 to 5.0. The electrodes were made of cobalt. The dispersion deposition took place at a temperature of 50° C. The optimal embedding rate of the $Al_2O_3$ particles was 5% by weight in the cobalt matrix. Experiment No. 7

Particles of a selflubricating polytetrafluorethylene (PTFE, Floun L 170) are to be deposited by a dispersion deposition out of a bath having the following composition and operating under the following conditions:

315 ml/liter of a nickel sulphamate solution, 30 grams/liter of a nickel chloride ($NiCl_2 \cdot 6H_2O$), 30 grams/liter of boric acid ($H_3BO_3$), 50 grams/liter of PTFE (Floun L 170) having a particle size of 3 to 4 μm, 0.1 gram/liter of sodium lauryl sulfate ($NaC_{12}H_{25}SO_4$) (used as an auxiliary stabilizer), 0.8 grams/liter of 1-aminoethyl-2-alkyl-alkenyl-imidazole (stabilizer), 50° C. bath temperature, bath motion stirring, 4.0–4.5 pH value, 2 amps/$dm^2$ current density, 20 /μm deposit layer thickness.

Experiment No. 8

Particles of selflubricating boron nitride BN are embedded in a nickel matrix by a dispersion deposition using the following bath composition and conditions.

630 ml/liter of nickel sulphamate solution,
5 grams/liter of nickel chloride ($NiCl_2 \cdot 6H_2O$),
30 grams/liter of boric acid ($H_3BO_3$),
0.8 grams/liter 1-aminoethyl-2-alkyl-alkenyl-imidazole,
0.1 grams/liter sodium lauryl sulfate,
50° C. bath temperature,
3.8–4.0 pH value,
25 μm deposit layer thickness,
2 amps/dm$^2$ current density,
bath motion stirring,
50 grams/liter of boron nitride (BN) type CS,
5 μm particle size of BN.

Experiment No. 9

The dependency of the particle embedding rate into the metal matrix as a function of the particle concentration in the bath is examined. The bath composition and the experiment conditions are substantially the same as in Experiment No. 1, except for the deviations as set forth in Table: II.

TABLE II

Showing the particle embedding rate as a function of the particle concentration in the bath.
Stabilizer: 1-amionethyl-2-alkyl-alkenyl-imidazole

| SiC (g/l) | Embedding Rate % by weight |
|---|---|
| 50 | 1.3 |
| 100 | 3.5 |
| 150 | 5.6 |
| 200 | 7.4 |
| cathodic current density | 2 amps/dm$^2$ |
| concentration of suspension stabilizer | 0.4 g/l |

Table: II shows that the embedding rate rises with the particles concentration in the bath.

Experiment No. 10

The dependency of the particle embedding rate into the metal matrix as a function of the concentration of the suspension stabilizer in the bath is examined. The bath composition and the experiment conditions correspond substantially to those in Experiment No. 1, except for the deviations set forth in Table: III.

TABLE III

Showing the particle embedding rate into the metal matrix as a function of the concentration of the suspension stabilizer in the bath.
Stabilizer: 1-aminoethyl-2-alkyl-alkenyl-imidazole

| Stabilizer Concentration (g/l) | Embedding Rate % by weight |
|---|---|
| 0.2 | 1.2 |
| 0.4 | 1.3 |
| 0.6 | 1.4 |
| 0.8 | 4.3 |
| 1.0 | 5.5 |
| cathodic current density | 2 amps/dm$^2$ |
| SiC-concentration | 50 g/l |

Table: III shows that the particle embedding rate rises with the increase in the suspension stabilizer concentration in the bath. The largest embedding rate increase is noted for a stabilizer concentration increase from 0.6 g/liter to 0.8 g/liter of stabilizer.

The materials suitable for embedding in the metal matrix by a galvanic dispersion deposition in the form of fine particles having a size in the range of 0.3 to 15 μm, preferably 0.4 to 10 μm, may be metal carbides such as SiC or TiC, oxides such as aluminum oxide or titanium oxide, borides, silicides, sulphites, nitrides such as boron nitride, sulphates, synthetic and natural materials including hard materials. Natural and synthetic graphite and mica are suitable for the present purposes. Diamond particles are a suitable hard material. Polytetrafluoroethylene is a suitable synthetic material. Particle mixtures of any two or xore of the listed substances are suitable for the present purposes.

In any of the various bath electrolytes disclosed herein, the pH value of the bath should be within the range of 3.5 to 5.

Although the invention has been described with reference to specific example embodiments, it will be appreciated, that it is intended to cover all modifications and equivalents within the scope of the appended claims.

What is claimed is

1. A bath with a suspension stabilizer for a galvanic dispersion deposition of a metal coating on a substrate, said metal coating having embedded in the metal coating other particles, comprising a main electrolyte and a cation active imidazole derivative acting as said suspension stabilizer, said suspension stabilizer satisfying the general formula

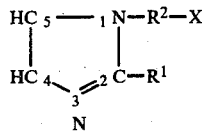

wherein $R^1$ is a monovalent hydrocarbon radical having at least four alphatically bound carbon atoms, $R^2$ is selected from the group consisting of methylene-, ethylene-, propylene-, and isopropylene-groups, and wherein X is selected from the group consisting of —$NH_2$, —$NHR^3$; —$NR^3R^4$, —OH, and $OR^5$, wherein $R^3$, $R^4$ and R5 are selected from the group consisting of methyl-, ethyl-, propyl-, and poly-glycolether radicals having up to five —O—$CH_2$—$CH_2$ groups.

2. The bath of claim 1, wherein said monovalent hydrocarbon radical $R^1$ is a saturated hydrocarbon radical.

3. The bath of claim 1, wherein said monovalent hydrocarbon radical $R^1$ is an unsaturated hydrocarbon radical.

4. The bath of claim 1, wherein said monovalent hydrocarbon radical $R^1$ is a mixture of saturated and unsaturated hydrocarbon radicals.

5. The bath of claim 1, wherein said monovalent hydrocarbon radical $R^1$ has up to twenty aliphatically bound C-atoms.

6. The bath of claim 1, wherein said monovalent hydrocarbon radical $R^1$ is a mixture of hydrocarbon radicals having up to twenty aliphatically bound C-atoms.

7. The bath of claim 1, wherein said $R^1$ is selected from the group consisting of alkyl-, alkenyl-, alkaryl-, aralkyl-, and aralkenyl- radicals.

8. The bath of claim 1, wherein said radical $R^1$ carries a substituent selected from the group consisting of chlorine, bromine, and iodine.

9. The bath of claim 1, wherein said radical $R^1$ is a mixture of aliphatic, saturated and unsaturated hydrocarbons having 8 to 18 C-atoms, wherein said $R^2$ is an ethylene group, and wherein X is a primary amino group.

10. The bath of claim 8, wherein said hydrocarbons are tallow radicals having 16 to 18 C-atoms.

11. The bath of claim 1, wherein said $R^1$ is a heptadecenyl radical, wherein $R^2$ is an ethylene group, and wherein X is an OH-group.

12. The bath of claim 1, further comprising a proportion of sodium lauryl sulfate forming an auxiliary stabilizer.

13. The bath of claim 1, comprising as said main electrolyte a solution including deionized water and the following components per liter of deionized water:

300 to 650 ml of nickel sulphamate solution having a concentration of 550 to 700 grams of solid sulphamate $(NH_2SO_3)_2Ni$ per liter, 5 to 35 grams of nickel chloride ($NiCl_2 \cdot 6H_2O$), and 25 to 45 grams of boric acid ($H_3BO_3$).

14. The bath of claim 1, comprising as said main electrolyte a solution including deionized water and the following components per liter of deionized water:

400 to 500 grams cobalt sulfate ($CoSO_4 \cdot 7H_2O$), 10 to 30 grams sodium chloride (NaCl), and 20 to 40 grams of boric acid ($H_3BO_3$).

15. The bath of claim 1, wherein said other particles are selected from the group consisting of metal carbides, oxides, borides, silicides, sulfides, nitrides, sulphates, synthetic materials, hard materials, and naturally occurring materials.

16. The bath of claim 14, wherein said metal carbides are selected from the group consisting of silicon carbide (SiC) and titanium carbide (TiC), wherein said oxides are selected from the group consisting of aluminum oxide ($Al_2O_3$) and titanium oxide ($TiO_2$), wherein said hard materials are selected from the group consisting of diamond particles and mica particles, wherein said nitride is boron nitride, wherein said synthetic material is selected from the group consisting of polytetrafluoroethylene, graphite and mica, and wherein said naturally occurring materials are selected from the group consisting of graphite and mica.

17. The bath of claim 14, wherein said other particles comprise a mixture of at least two of said materials.

18. The bath of claim 14, wherein said other particles have a particle size within the range of 0.3 to 15 $\mu$m, preferably within the range of 0.4 to 10 $\mu$m.

19. The bath of claim 1, wherein said electrolyte has a pH-value of about 3.5 to 5.

* * * * *